United States Patent [19]

Gasser

[11] Patent Number: 4,967,449

[45] Date of Patent: Nov. 6, 1990

[54] DEVICE FOR DEPOSITING A TEXTILE SLIVER IN A CAN

[75] Inventor: Hermann E. Gasser, Frauenfeld, Switzerland

[73] Assignee: Hollingsworth GmbH, Neubulach, Fed. Rep. of Germany

[21] Appl. No.: 388,278

[22] Filed: Aug. 1, 1989

[30] Foreign Application Priority Data

Aug. 2, 1988 [DE] Fed. Rep. of Germany ... 8809870[U]

[51] Int. Cl.[5] ..... B65H 54/80; B65H 54/82

[52] U.S. Cl. ..... 19/159 R; 19/157

[58] Field of Search ..... 19/159 R, 159 A, 157

[56] References Cited

U.S. PATENT DOCUMENTS

| | | | |
|---|---|---|---|
| 3,105,996 | 10/1963 | Naegeli | 19/159 R |
| 3,141,201 | 7/1964 | Gasser | 19/159 R |
| 3,172,185 | 3/1965 | Langway et al. | 19/159 R |
| 4,041,574 | 8/1977 | Müller | 19/159 R |
| 4,372,010 | 2/1983 | Gauvain | 19/159 R |

FOREIGN PATENT DOCUMENTS

| | | | |
|---|---|---|---|
| 1115622 | 10/1961 | Fed. Rep. of Germany | 19/159 R |
| 1115623 | 10/1961 | Fed. Rep. of Germany | 19/159 R |
| 2711175 | 9/1978 | Fed. Rep. of Germany | 19/159 R |
| 3407136 | 2/1984 | Fed. Rep. of Germany . | |
| 3624742 | 7/1986 | Fed. Rep. of Germany . | |

*Primary Examiner*—Werner H. Schroeder
*Assistant Examiner*—John J. Calvert
*Attorney, Agent, or Firm*—Townsend and Townsend

[57] ABSTRACT

The present invention refers to a device for depositing a textile sliver in a can, comprising a bent delivery pipe, which is adapted to be rotated about a substantially vertical axis and the mouth of which ends in front of a stationary wall projecting into the cross-section of the mouth of the bent delivery pipe.

The task to be solved by the present invention is the task of simplifying a device of the type mentioned at the beginning and treating the sliver with care at the same time.

In accordance with the present invention, this task is solved by the features that a pressure-exerting member, which is directed towards the stationary wall and which moves together with the belt delivery pipe, is arranged behind the mouth of the bent delivery pipe when seen in the direction of rotation, the coefficient of friction of the wall being higher than the coefficient of friction of the pressure-exerting member, when measured in the direction of rotation of the bent delivery pipe.

19 Claims, 4 Drawing Sheets

DEVICE FOR DEPOSITING A TEXTILE SLIVER IN A CAN

DESCRIPTION

Figure 1:
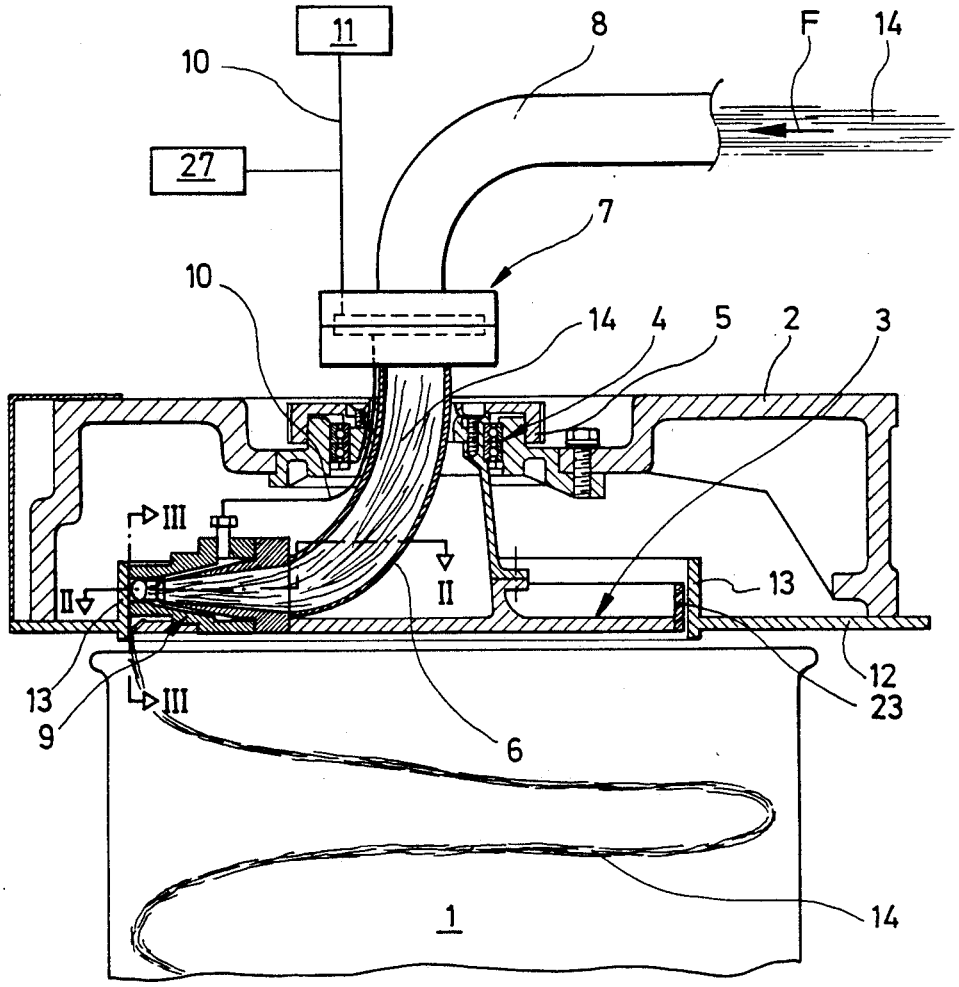

The present invention refers to a device for depositing a textile sliver in a can, comprising a bent delivery pipe, which is adapted to be rotated about a substantially vertical axis and the mouth of which ends in front of a stationary wall projecting into the cross-section of the mouth of said bent delivery pipe.

Devices of the type mentioned at the beginning are used for depositing the slivers supplied from a card in socalled coiler cans. From said coiler cans, the slivers are then supplied to additional processing stations.

A device of the type mentioned at the beginning is known from EP-A-220 328. In the case of said European patent application, the sliver is transported by means of a pair of calender rollers into the rotating bent delivery pipe, and from said bent delivery pipe it falls downwards into a can moving relative to said rotating bent delivery pipe. The relative movement between the can and the rotating bent delivery pipe is required for depositing the sliver in a cycloidal pattern. In the case of the known device, the stationary wall projects partly into the cross-section of the mouth of the bent delivery pipe. This feature is used for preventing the sliver from blocking the bent delivery pipe, such blocking being prevented due to the fact that the frictional forces between the stationary wall and the sliver, which is moved past said stationary wall by the rotating bent delivery pipe, draw said sliver out of the bent pipe, whereby the drive of the sliver by means of the two calender rollers is supported. In order to prevent the sliver from adhering to the wall, the mouth of the bent delivery pipe is inclined downwards so that the sliver impinges on the stationary wall from above at an oblique angle.

Although it appears to be possible that the known device is able to avoid blocking of the bent delivery pipe and to support the transport work of the calendar rollers, the sliver, when leaving the bent delivery pipe, is subjected to undesirable stress. In view of the fact that the relative speed between the mouth of the bent delivery pipe and the stationary wall is to be lower than the circumferential speed of the bent delivery pipe, there will also be a relative speed between the sliver leaving the bent delivery pipe and the stationary wall. This relative movement is superimposed by an additional relative movement resulting from the fact that the sliver impinges on the stationary wall from above at an oblique angle. This has the effect that the sliver is impaired. Moreover, for advancing the sliver, the known device additionally requires the driven calender rollers, which are arranged above and in front of the bent delivery pipe, so that the relative speed between the bent delivery pipe and the stationary wall must be adjusted to the advancing rate of the calender rollers for avoiding additional damage to the sliver. This requires complicated control means.

Hence, the present invention is based on the task of simplifying a device of the type mentioned at the beginning and treating the sliver with care at the same time.

In accordance with the present invention, this task is solved by the features that a pressure-exerting member, which is directed towards the stationary wall and which moves together with the bent delivery pipe, is arranged behind the mouth of the bent delivery pipe when seen in the direction of rotation, the coefficient of friction of the wall being higher than the coefficient of friction of the pressure-exerting member, when measured in the direction of rotation of the bent delivery pipe.

After having left the mouth of the bent delivery pipe, the sliver comes to a standstill on the stationary wall. No relative movement takes place between the stationary wall and the sliver when the sliver is leaving the bent delivery pipe. To put it more correctly, the sliver is drawn out of the bent delivery pipe by the stationary wall due to the fact that it is wedged in between the pressure-exerting member and said stationary wall. Hence, it is no longer necessary to provide a pair of calender rollers so as to effect the advanace movement of the sliver through the bent delivery pipe. It follows that three goals are achieved at the same time, viz. firstly a simplification of the device from the structural point of view as well as from the point of view of control technology, secondly a careful treatment of the sliver and thirdly the omission of a speed adaptation of calender rollers. At a place located behind the pressure-exerting member in the direction of rotation, the sliver deposited on the wall can be deflected downwards by a stripper, and this will simultaneously have the effect that the stationary wall is cleaned. By means of the device according to the present invention, deposition of the sliver can be carried out in a practically speed-independent manner, the deposition rates thus achieved exceeding by far those which can be achieved by means of conventional devices.

In accordance with a preferred embodiment, the bent delivery pipe opens into a plane which extends essentially at right angles to the stationary wall.

This provides the advantage that, upon impinging on the stationary wall, the sliver is deflected in only one plane, and this will additionally contribute to a careful treatment of the sliver.

The stationary wall is constructed as the inner wall of a solid of revolution in an advantageous manner. In the case of conical or spherical solids of revolution, a change in the deposition radius of the sliver can be achieved by a vertical adjustment of the bent delivery pipe, since the mouthpiece must then migrate radially outwards or radially inwards. Although this radial adjustment cannot be effected when the stationary wall is constructed as the inner wall of a hollow cylinder, this structural design is preferred, since it is simple from the structural point of view and since is produces satisfactory results in most cases of use.

In accordance with an advantageous further development, the stationary wall is provided with a substantially vertically oriented fluting. This fluting has the effect that the friction of the stationary wall is increased in the tangential direction, i.e. in the direction of rotation of the bent delivery pipe, whereas it can be limited to a very small value in the vertical direction so that, in the case of low sliver speeds, the sliver can fall downwards into the coiler can automatically and only due to the force of gravity at a location behind the pressure-exerting member.

In a particularly advantageous manner, the pressure-exerting member can be constructed as a slide guide means, which is secured to the mouth of the bent delivery pipe and which tangentially clings to the mouth of the bent delivery pipe on the one hand and to the stationary wall on the other. This has the effect that the number of moving parts is kept small, and this contributes to a structural simplification of the device. On the other hand, the pressure-exerting member can also be constructed as a rotatable roller in an advantageous manner, the axis of rotation of said rotatable roller extending essentially parallel to the stationary wall. In the case of this embodiment, the coefficient of friction of the roller, which is smaller in comparison with that of the stationary wall, is determined by the rotatable support of the roller. As far as the roller is concerned, it is not important whether its surface has a low coefficient of friction, since its surface does not carry out any movement relative to the sliver. Although the provision of a rotatable roller means that a movable structural component is added, this embodiment can be advantageous in particular for devices with lower sliver speeds, since, being a solid of revolution, a roller can be produced without difficulties.

Although, depending on the structural design of the stationary wall and on the respective sliver speed, the force of gravity can already be sufficient for making the sliver fall downwards behind the pressure-exerting member, an inclined surface, which deflects the sliver downwards on the wall, is arranged after the pressure-exerting member in the direction of rotation of the bent delivery pipe in accordance with a preferred embodiment. This inclined surface is advantageous especially in cases in which the device is intended to operate with high sliver speeds. The inclined surface has the effect that the sliver, which is firmly pressed against the wall by the pressure-exerting member, is stripped off the stationary wall.

In accordance with a specially preferred embodiment, the mouth of the bent delivery pipe is formed by a gas injector, which is followed by the pressure-exerting member. It is thus possible to draw the sliver automatically into the bent delivery pipe and to press the leading end of the sliver against the stationary wall. As soon as the pressure-exerting member takes hold of the leading end of the sliver and presses said end against the stationary wall, the gas injector can be switched off.

Another advantageous embodiment is an embodiment in the case of which the inner cross-section of the mouth of the bent delivery pipe tapers conically in the direction of transport of the sliver. The sliver can thus be drawn out of the bent delivery pipe and deposited in a very compact form. This does not only have the effect that a higher filling degree of the cans is achieved, but it will also make the sliver less sensitive to external mechanical influences.

When the pressure-exerting member is provided with a substantially horizontal groove, which opens into the transport path of the sliver and which extends essentially from the mouth of the bent delivery pipe up to a pressure-exerting surface extending essentially parallel to the stationary wall, the sliver can be guided in this groove during the deposition process. On the other hand, this groove will have the effect that the air required for inserting the sliver can escape easily without accumulating behind the mouth of the bent delivery pipe during the period of insertion of the sliver, i.e. during the period in which the gas injector is in operation.

For transporting - upon insertion of the sliver - the leading end of the sliver into the gap between the pressure-exerting member and the stationary wall, it will be advantageous when the pressure-exerting member, which follows the gas injector of the bent delivery pipe, forms a mouthpiece channel, which is defined by the slide guide means on the one hand and by an opposite flow wall on the other. The oppositely disposed flow wall has the effect that a flow of air is generated, which is directed precisely into the gap between the pressure-exerting member and the stationary wall. Hence, the leading end of the sliver will be transported precisely into this gap.

The precisely directed flow of air, which is used for inserting the leading end of the sliver into the gap between the stationary wall and the pressure-exerting member, can be obtained in a simple manner on the basis of the feature that the flow wall has a curvature which is essentially identical with that of the slide guide means.

When the flow wall has provided therein a venting slot, excessive air can easily escape without there being any risk of an accumulation of air.

The gas injector is connected to a control circuit in an advantageous manner, said control circuit switching off the supply of air to the gas injector as soon as the leading end of the sliver has reached the pressure-exerting member, since transport of the sliver by means of the bent delivery pipe is then taken over by the stationary wall, the mouth of the bent delivery pipe brushing along said stationary wall in passing.

In accordance with a preferred embodiment of the invention, the bent delivery pipe, the gas injector and the pressure-exerting member are arranged on a revolving plate, the inclined surface, which is arranged behind the pressure-exerting member, being formed as part of the rim of said revolving plate and said rim of said revolving plate being fitted into the stationary wall. A structural unit is thus obtained, which, for the purpose of maintenance or exchange, can easily be removed downwards from the housing including the stationary wall.

The rim is made of plastic material in an advantageous manner. This shows the advantage that the rim can wear in with regard to the stationary wall so that only a minimum amount of play will exist between the rim and the wall.

Figure 2:
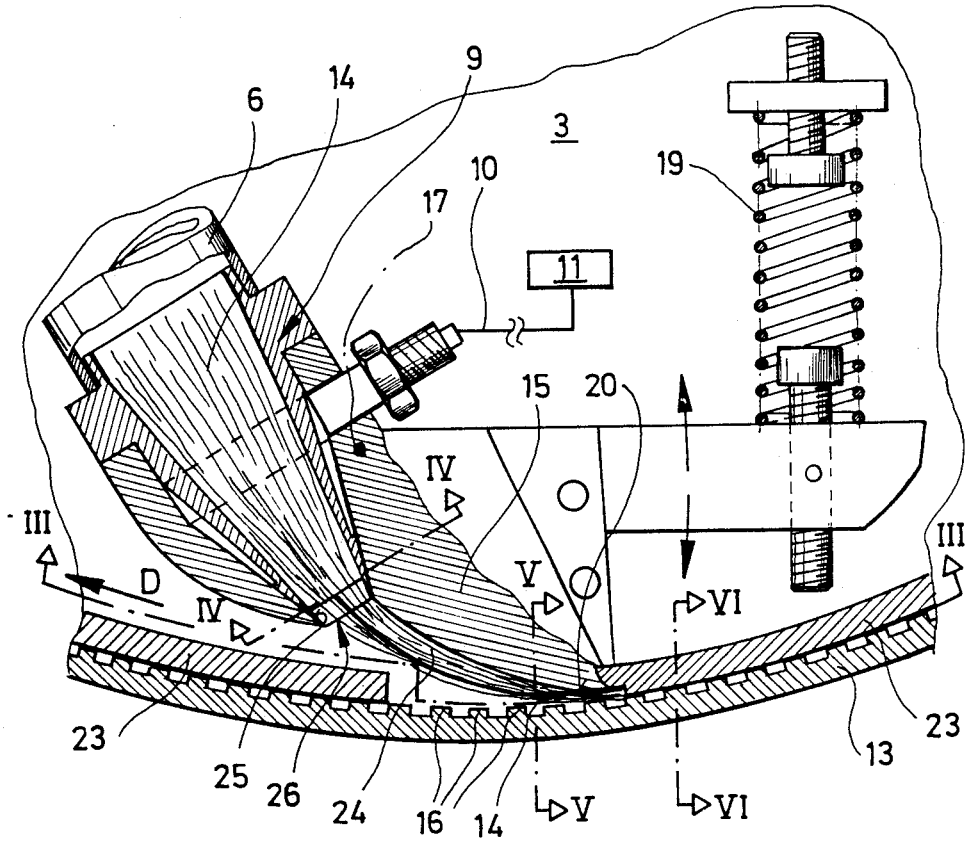
Figure 4:
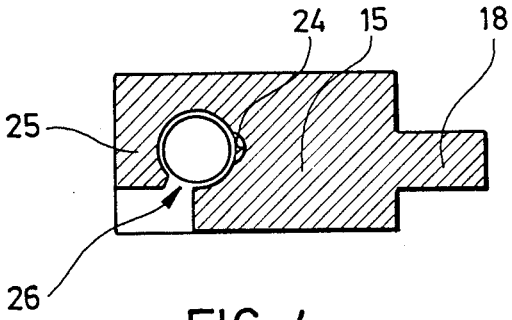
Figure 3:
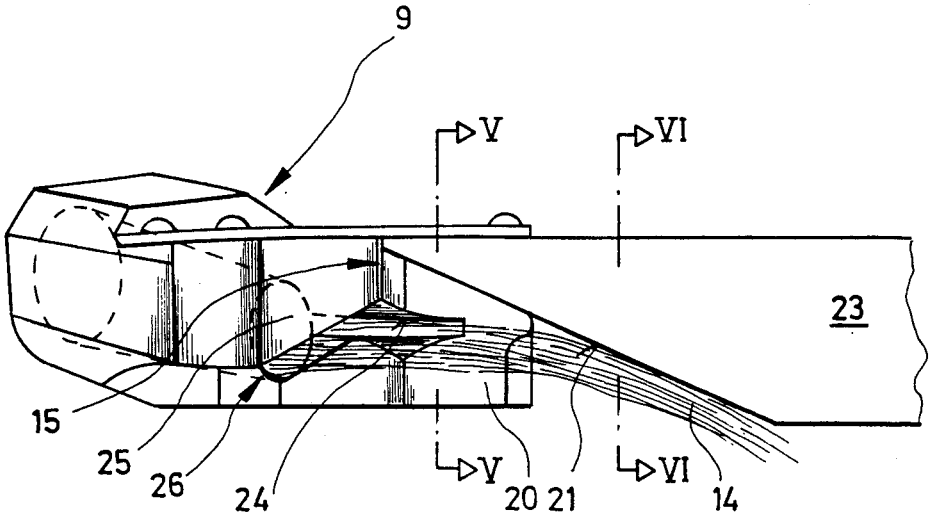
Figure 5:
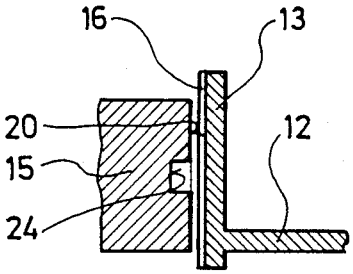
Figure 6:
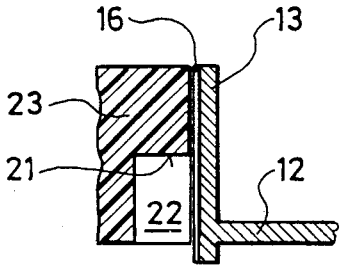
Figure 7:
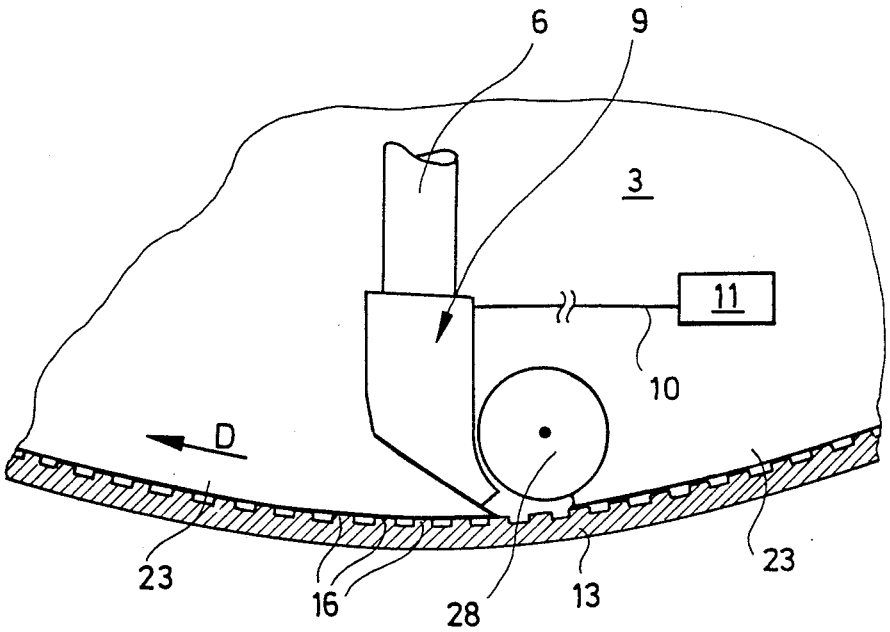

In the following, embodiments of the present invention will be explained in detail on the basis of a drawing in which FIG. 1 shows a side view of a partially cut device according to the present invention in accordance with a first embodiment, FIG. 2 shows an enlarged view revealing a part of the revolving plate of the device of FIG. 1, partially cut along the line II—II, FIG. 3 shows a section through FIG. 2 along the line III—III, FIG. 4 shows a section along the line IV—IV of FIG. 2, FIG. 5 shows a section along the line V—V of FIG. 2, FIG. 6 shows a section along the line VI—VI of FIG. 2, and FIG. 7 shows in a view which is similar to that of FIG. 2 a schematic representation of an additional embodiment.

FIG. 1 shows a device according to the present invention used for depositing a textile sliver in a coiler can 1. The device comprises a housing 2 having arranged therein a revolving plate 3 which is adapted to be rotated relative to the housing 2 about a substantially vertical axis. The revolving plate 3 is held within the housing 2 via a support 4. Above the support 4, the revolving plate 3 has fixed thereto a pulley 5 around which a driving belt can be placed, which is not shown in detail and which leads to an electric motor which is not shown in detail either. The revolving plate 3 can be caused to rotate relative to the housing 2 via the motor, the belt and the pulley 5.

The revolving plate 3 has fixed thereto a bent delivery pipe 6 rotating together therewith. The bent delivery pipe 6 is connected to a stationary pipe conduit 8 via a rotary joint.

The mouth of the bent delivery pipe 6 is formed by a gas injector 9 which is attached to said revolving plate 3. Such a gas injector 9 is explained in detail in EP-A-261 330, and, consequently, the details of such a gas injector are not discussed very thoroughly.

The gas injector 9 is connected to a source of compressed air 11 via an air tube 10. The air tube 10 leads through the rotary joint 7 so that the upper part of said air tube 10 is stationary, whereas the lower part of said air tube rotates together with the bent delivery pipe 6.

The housing 2 is provided with a base plate 12, which is positioned approximately on one level with the revolving plate 3 and which surrounds said revolving plate 3 with a cylindrical wall 13. The cylindrical wall 13 is stationary relative to the revolving plate 3.

In the case of the embodiment shown in this figure, the coiler can 1 is moved relative to the housing 2 so that a relative movement is caused between the rotating revolving plate 3 and the coiler can 1, said relative movement having the effect that the sliver 14 is deposited in the coiler can 1 in a cycloidal shape. The same can also be achieved when the housing 2 is rotated—similar to the revolving plate 3— about an axis which is parallel to the axis of rotation of the revolving plate 3. Such devices have been known from the prior art for a long time.

As can easily be seen from FIG. 1, the cylindrical wall 13 projects into the cross-section of the mouth of the bent delivery pipe 6. To put it more correctly, the cylindrical wall 13 fully covers the cross-section of the mouth of the bent delivery pipe 6.

As can be seen even more clearly from FIG. 2, a pressure-exerting member 15, which is directed towards the stationary cylindrical wall 13 and which moves together with the bent delivery pipe 6, is arranged behind the gas injector 9 when seen in the direction of rotation D of the bent delivery pipe 6, the coefficient of friction of the cylindrical wall 13 being higher than the coefficient of friction of the pressure-exerting member 15 in the direction of rotation D of the bent delivery pipe 6. For this purpose, the stationary cylindrical wall 13 is provided with a substantially vertically oriented fluting 16.

The pressure-exerting member 15 is secured to the gas injector 9 and it tangentially clings to the mouth of the gas injector 9 as a slide guide means on the one hand and to the stationary wall 13 on the other.

The structural unit comprising the gas injector 9 and the pressure-exerting member 15 is supported on a pivot shaft 17 which extends parallel to the cylindrical wall 13. The pressure-exerting member 15 has additionally attached thereto a pivotable lever 18, which is fixedly connected thereto and which rests on the base plate of the revolving plate 3 via a spring 19. This has the effect that a pressure-exerting surface 20 of the pressure-exerting member 15 is always pressed against the cylindrical wall 13 in an elastic manner. In FIG. 2, the pressure-exerting surface 20 is shown in spaced relationship with the stationary wall 13, since the sliver 14 is already located between the pressure-exerting surface 20 and the stationary wall 13 in said figure.

As is particularly well shown in FIG. 3 and 6, an inclined surface 21 is provided after the pressure-exerting member 15, more exactly after the pressure-exerting surface 20, in the direction of rotation D of the bent delivery pipe 6, said inclined surface 21 deflecting the sliver 14 downwards. The inclined surface 21 is provided by means of a recess 22 provided in the rim 23 of the revolving plate 3. The revolving plate 3 has its rim 23 fitted into the cylindrical wall 13 so that practically no play exists between the rim 23 and the cylindrical wall 13.

A look at FIG. 1 will show that the bent delivery pipe 6 or rather the gas injector 9 opens into a plane which is arranged at right angles to the cylindrical wall 13. In view of the fact that the cylindrical wall extends vertically in the case of this embodiment, the gas injector opens into a horizontal plane. The gas injector 9 converges conically so that the sliver 14 is caused to taper and is compressed. As can most easily be seen from FIG. 3 and 5, the sliver leaving the gas injector is guided in a groove 24 opening into the transport path of the sliver 14 and from said groove 24 it is moved onto the pressure-exerting surface 20. The groove 24 forms one half of a mouthpiece channel of the gas injector, said channel being completed by a flow wall 25 provided on the other side. The flow wall has a curvature which is essentially identical with that of the slide guide means or rather the groove 24. On the lower slide of the flow wall 25, a venting slot 26 is provided through which excessive air can escape so that an accumulation of air behind the gas injector 9 is avoided. The gas injector 9 is connected to a control circuit 27, which switches off the supply of air to the gas injector 9 as soon as the leading end of the sliver 14 has reached the pressure-exerting member 15. For the purpose of effecting this control, the pressure existing within the air tube 10 can be used, said pressure changing upon insertion of the sliver 14 into the gas injector. It is also possible to use the deflection of the pivotable lever 18, when the sliver 14 is being inserted into the gap between the stationary wall 13 and the pressure-exerting member 15.

In the following, the function and the mode of operation of the device according to the first embodiment will be explained in detail. First of all, the revolving plate 3 is driven via the pulley 5 and caused to rotate. Subsequently, compressed air is applied to the gas injector 9 by means of the source of compressed air 11 via the air tube 10, and this has the effect that a flow is generated in the pipe conduit 8 and in the bent delivery pipe 6. This flow of air sucks a sliver 14 through the pipe conduit 8 and through the gas injector 9 up to and into the gap between the pressure-exerting member 15 and the stationary cylindrical wall 13. As soon as the silver has passed the gas injector 9, the pressure in the air tube 10 will rise so that the control circuit 27 will interrupt the supply of air to the gas injector. Air which is at that moment in front of the mouth of the gas injector 9 can escape through the venting slot 26. As soon as the sliver 14 has been wedged in between the pressure-exerting member 15, which is acted upon by the spring 19, and the stationary cylindrical wall 13, transport of the sliver by the bent delivery pipe is exclusively achieved by means of this clamping effect: the sliver 14 is held in position on the cylindrical wall 13 by means of the pressure-exerting member, whereas the bent delivery pipe 6 rotates together with the revolving plate 3. In view of the fact that the pressure-exerting member 15 has a very smooth surface, it can move together with the mouth or rather the gas injector 9 of the bent delivery pipe 6 without causing the sliver 14 to move as well. On the contrary, when seen in the direction of rotation of the bent delivery pipe 6, the sliver 14 remains fixedly on the cylindrical wall 13. As soon as the pressure-exerting member 15 has released the sliver 14, said sliver can slide downwards due to the force of gravity, since the fluting 16 is oriented vertically and causes an increase in the coefficient of friction only in the direction of rotation of the bent delivery pipe 6, but not in the vertical direction. The inclined surface 21, which is formed in the rim 23 of the revolving plate 3, helps to press the sliver 14 downwards so that said sliver will move helically downwards into the coiler can 1. In view of the fact that, relative to the housing 2 of the device, the coiler can 1 is rotated about an axis which is eccentric with regard to the revolving plate axis, the sliver 14 will be deposited in the coiler can 1 in a cycloidal shape.

In FIG. 7, an additional embodiment of a device according to the present invention is schematically shown. This device corresponds essentially to the device according to FIG. 1 to 6, and, consequently, identical reference numerals will be used for identical and for similar structural components.

However, in the case of this second embodiment, a pressure-exerting roller 28 is provided instead of the pressure-exerting member constructed as a slide guide means, said pressure-exerting roller 28 pressing the sliver 14 against the cylindrical wall 13 when it has left the gas injector 9. In all other respects, the function corresponds to that in the case of the first embodiment.

Although the stationary wall is constructed as a cylindrical wall in the case of the embodiment described in the present connection, it is also imaginable that said stationary wall can be the inner wall of a cone or of a hemisphere which is open at the bottom thereof. It would then be possible to vary the distance between the mouth of the bent delivery pipe and the axis of rotation of the revolving plate.

Furthermore, this embodiment has been described on the basis of a moving coiler can. It is, however, also possible that the housing 2 of the revolving plate 3 itself is driven to move about an axis which is parallel to the axis of rotation of the revolving plate 3 so as to achieve a cycloidal mode of deposition of the sliver in the coiler can.

I claim:

1. A device for depositing a textile sliver in a can, comprising:

a bent delivery pipe, having a mouth, and rotatable about a substantially vertical axis and a stationary wall projecting into a cross-section of the mouth of the bent delivery pipe, whereby, upon causing rotation of the device, sliver is drawn from the bent delivery pipe by the effect friction of the stationary wall; and a pressure-exerting member, which is disposed between the mouth of said bent delivery pipe and said stationary wall, canted towards said stationary wall, and mounted for movement with the bent delivery pipe;

the stationary wall having a coefficient of friction higher than a coefficient of friction of the pressure-exerting member when said coefficients of friction are measured in a direction of rotation of the bent delivery pipe.

2. A device according to claim 1, wherein the bent delivery pipe opens into a plane which extends essentially at right angles to the stationary wall.

3. A device according to claim 1, wherein the stationary wall is constructed as the inner wall of a solid of revolution.

4. A device according to claim 1, wherein the stationary wall comprises an inner wall of a hollow cylinder.

5. A device according to claim 1, wherein the stationary wall further comprises a substantially vertically oriented fluting.

6. A device according to claim 1, wherein the pressure-exerting member is secured to the mouth of the bent delivery pipe and is tangential to the mouth of the bent delivery pipe and to the stationary wall.

7. A device according to claim 1, wherein the pressure-exerting member comprises a rotatable roller having an axis of rotation extending essentially parallel to the stationary wall.

8. A device according to claim 1, further comprising an inclined surface deflecting the sliver downwards on the stationary wall.

9. A device according to claim 1, wherein the mouth of the bent delivery pipe comprises a gas injector and the pressure-exerting member.

10. A device according to claim 1, wherein an inner cross-section of the mouth of the bent delivery pipe tapers conically in a direction of transport of the sliver.

11. A device according to claim 1, wherein the pressure-exerting member further comprises a substantially horizontal groove opening into a transport path of the sliver and extending essentially from the mouth of the bent delivery pipe to a surface extending essentially parallel to the stationary wall.

12. A device according to claim 6, wherein the pressure-exerting member forms a channel defined by the slide guide means member and by a flow wall.

13. A device according to claim 12, wherein the flow wall has a curvature which is essentially identical with a curvature of the slide guide means member.

14. A device according to claim 12, wherein the flow wall comprises a venting slot.

15. A device according to claim 9 wherein the gas injector is connected to a control circuit for switching off a supply of air to the gas injector when a leading end of the sliver has reached the pressure-exerting member.

16. A device according to claim 8, further comprising a revolving plate on which the bent delivery pipe, a gas injector and the pressure-exerting member are arranged; said revolving plate, having a rim and the inclined surface forming a part of said rim; and wherein said rim of said revolving plate is fitted into the stationary wall.

17. A device according to claim 16, further comprising the pressure-exerting member a spring resting on the revolving plate, and exerting a force on said guide member in a direction of the stationary wall.

18. A device according to claim 16, wherein the pressure-exerting member is pivotally supported on the revolving plate such that said guide member is pivotable about a pivot shaft extending parallel to the stationary wall.

19. A device according to claim 16, wherein the rim of the revolving plate comprises plastic material.

* * * * *